US007961064B2

(12) United States Patent
Kearns et al.

(10) Patent No.: US 7,961,064 B2
(45) Date of Patent: Jun. 14, 2011

(54) DIRECTIONAL COUPLER INCLUDING IMPEDANCE MATCHING AND IMPEDANCE TRANSFORMING ATTENUATOR

(75) Inventors: Brian Kearns, Dublin (IE); John Costello, Dublin (IE)

(73) Assignee: TDK Corporation, Tokyo (JP)

( * ) Notice: Subject to any disclaimer, the term of this patent is extended or adjusted under 35 U.S.C. 154(b) by 241 days.

(21) Appl. No.: 12/320,639

(22) Filed: Jan. 30, 2009

(65) Prior Publication Data

US 2010/0194489 A1 Aug. 5, 2010

(51) Int. Cl.
*H01P 5/12* (2006.01)
*H01P 1/22* (2006.01)

(52) U.S. Cl. ..... 333/109; 333/116

(58) Field of Classification Search ..... 333/109, 333/110, 111, 112, 115, 116
See application file for complete search history.

(56) References Cited

U.S. PATENT DOCUMENTS

| | | | | |
|---|---|---|---|---|
| 6,642,809 | B2 | 11/2003 | Shin et al. | |
| 6,771,141 | B2 | 8/2004 | Iida et al. | |
| 7,026,887 | B2 * | 4/2006 | Watanabe et al. | 333/126 |
| 7,034,633 | B2 * | 4/2006 | Passiopoulos et al. | 333/116 |
| 7,394,333 | B2 | 7/2008 | Ezzeddine et al. | |
| 2007/0279147 | A1 | 12/2007 | Dupont et al. | |

* cited by examiner

*Primary Examiner* — Dean O Takaoka
(74) *Attorney, Agent, or Firm* — Oliff & Berridge, PLC

(57) ABSTRACT

The present invention provides a compact weakly coupled directional coupler combined with an integrated impedance transformation and matching circuit where the impedance transformation and matching circuit facilitates the fabrication of a highly miniaturized directional coupler with optimum electrical performance where the physical dimensions of the coupled transmission lines fall inside the constraints of the fabrication process.

15 Claims, 13 Drawing Sheets

DIRECTIONAL COUPLER INCLUDING IMPEDANCE MATCHING AND IMPEDANCE TRANSFORMING ATTENUATOR

FIELD OF THE INVENTION

The present invention relates to a directional coupler including an impedance matching and impedance transforming attenuator, in particular, a directional coupler for power monitoring, RF circuits or RF front-end circuits.

BACKGROUND OF THE INVENTION

In recent times, wireless handsets and terminals have evolved to have a high level of functionality while also becoming extremely compact. Wireless handsets and terminals often include a range of personal media functions, and are capable of operating on multiple systems such as the Global System for Mobile Communications (GSM) and the Universal Mobile Telephone System (UMTS). The components of the various systems in a contemporary wireless handset are required to offer high performance while the physical dimensions are required to become progressively smaller.

In the RF front-end circuit of a wireless handset, a power monitoring circuit is usually employed to control the transmitted power, for example, to ensure that the handset conforms with emission regulations pertaining to the system of operation and in the region of operation and in order to conserve battery life. A prior art block diagram of a conventional power monitoring circuit of an RF front-end circuit is shown in FIG. 1.

The directional coupler is a well known RF device which is used for monitoring the level of power traveling along a signal line in a particular direction. A directional coupler comprises a pair of transmission lines which are in close physical proximity to each other so that they become electromagnetically coupled to each other. A single transmission line can be characterized primarily by its electrical length and its characteristic impedance, thus a pair of transmission lines has a pair of electrical lengths and a pair of characteristic impedances. A coupled pair of transmission lines, such as those of a directional coupler, are more commonly characterized by the even mode impedance and the odd mode impedance and the even mode phase length and the odd mode phase length of the coupled transmission lines.

FIG. 2A shows a diagram of a prior art directional coupler. The directional coupler of FIG. 2A comprises a pair of transmission lines 25 which are electromagnetically coupled to each other. Both of the transmission lines have input/output (I/O) ports at each end, so that the pair of coupled transmission lines 25 comprise four I/O ports. The I/O ports are labeled as an input port 21, a direct port 22, a coupled port 23 and an isolated port 24. The pair of transmission lines of the directional coupler of FIG. 2A are formed so as to be embedded inside or on the surface of an insulating substrate and the transmission lines may be arranged to provide broadside coupling i.e. where respective broadsides of each line are adjacent to each other or to provide edge coupling i.e. where respective edges of each line are adjacent to each other. When a signal is fed to the input port 21 of the directional coupler of FIG. 2A, inevitably, some of the signal is fed to the output port 22; however, the electromagnetic coupling between the transmission lines is such that a signal on one line induces a corresponding signal on the other line so that some of the input signal is also fed to the coupled port 23, and under certain (non-ideal) conditions some of the input signal may also be fed to the isolated port 24.

The structure depicted in FIG. 2A has at least one axis of symmetry 20, and may have further axes of symmetry (not shown), so the designation of labels to the ports is somewhat arbitrary; for example, an input could be fed to port 22, so that the direct port would become port 21, the coupled port would become port 24 and so that the isolated port would become port 23.

Directional couplers can be broadly categorized as either equal coupling or weakly coupled. Directional couplers offering roughly equal power splitting between the direct port and the coupled port—known as 3 dB couplers—typically comprise transmission lines having an electrical length equal to one quarter of the wavelength of the operating frequency of the coupler. Weakly coupled directional couplers, i.e. those which pass most of the input power to the direct port, and which couple only a small percentage thereof to the coupled port, may also comprise lines with an electrical length equal to one quarter of one wavelength; alternatively, such couplers can be fabricated using lines which are much shorter than one quarter of one wavelength. The choice of the electrical length depends on the required operating bandwidth, the required coupling ratio and the physical limitations of the fabrication process.

For couplers comprising short transmission lines (i.e. where the electrical length of the transmission lines is substantially less than one quarter of one wavelength at the frequency of operation of the directional coupler) and lines of equal length, the even mode phase length and odd mode phase length are approximately equal. Hence, such couplers can be characterized by three main parameters: the even mode impedance, the odd mode impedance, and the electrical length.

The operating performance of a directional coupler is usually given in terms of four electrical specifications: the coupling ratio, the insertion loss, the isolation and the return loss. These specifications can be determined analytically from the characterizing parameters of the directional coupler, or by direct measurement. The first specification, the coupling ratio, is a measure of the RF power which is emitted at the coupled port for a given level of power fed to the input port. Typically, this value is expressed as a ratio measured in decibels. Practical coupling ratios can vary from as low as −40 dB (corresponding to very weakly coupled lines) to −3 dB (strongly coupled lines providing equal power splitting between the direct port and the coupled port). The second specification for the performance of a directional coupler is the insertion loss for signals passing between the input port and the direct port. For couplers offering weak coupling between the input port and the coupled port, the insertion loss should be very low; for example, a coupling ratio of 1:10 (−10 dB at the coupled port) will give rise to a theoretical minimum insertion loss of 0.45 dB. Table 1 gives the relationship between the coupling ratios (in decibels) and the minimum insertion loss for a matched RF coupler. The third specification of the directional coupler is the isolation. A well designed directional coupler will feed power from the input port to the direct port and to the coupled port only. Thus, there should be no power at the isolated port so that an ideal coupler would have infinite isolation. In practice, some power is always passed to the isolated port, and the isolation of the coupler gives the relative level of this power. The final specification of a directional coupler, the return loss, can be measured at each port. Typically, a directional coupler is designed to be terminated into 50Ω loads at each port, and the return loss is a measure of how closely matched the impedance presented by the coupler at a given port is to the impedance terminating the same port.

An alternative measure of the isolation of a directional coupler is the directivity, which is the isolation in decibels minus the coupling ratio in decibels. In this context, a coupler can be described as a high directivity coupler if there is a very low ratio of the power fed to the isolated port from the input port compared with the power fed to the coupled port from the input port.

It is well known in the design of a directional coupler, that a critical requirement for high isolation and high directivity is that the product of the even mode impedance $Z_{0E}$ of the coupled transmission lines with the odd mode impedance $Z_{0O}$ of the coupled transmission lines should be equal to the square of the reference terminating impedance $Z_0$ on the four ports of the directional coupler—see EQUATION 1 below. For example, see Mongia, R; Bahl, I; Bhartia, P; "RF and Microwave Coupled Line Circuits" ISBN: 0-89006-830-5; Artech House 1999; pp 137. The standard reference impedance $Z_0$ in most RF applications is 50 Ohms.

$$Z_{0O} \times Z_{0E} = Z_O^2 \qquad \text{EQUATION 1}$$

Generally speaking, the even mode impedance is determined by the physical dimensions of the coupled transmission lines the properties of the material surrounding them and the proximity of the coupled transmission lines to RF ground. On the other hand, the odd mode impedance is a function of the physical dimensions of the coupled transmission lines the properties of the material between the two transmission lines and the proximity of the coupled transmission lines to each other. Thus, both parameters are independent of each other, and the criteria of EQUATION 1 can be met provided that there are no limitations in the fabrication process of the coupled transmission lines.

FIG. 2B shows an alternative prior art directional coupler which includes resistive attenuators 26, 28 connected at the coupled and isolated ports of FIG. 2A respectively. Resistive attenuators 26, 28 are both two terminal devices, a first terminal of resistive attenuator 26 is connected to coupled port 23, and a second terminal of attenuator 26 provides a matched coupled port 27 of the directional coupler; similarly, a first terminal of resistive attenuator 28 is connected to isolated port 24, and a second terminal of attenuator 28 provides a matched isolated port 28 of the directional coupler. Resistive attenuator 26, connected at coupled port 23, is provided to reduce the effect of a mismatch from a connection at matched coupled port 27 of the directional coupler. A mismatch would occur, for example, if the impedance connected at matched coupled port 27 of the directional coupler were not exactly equal to 50 Ohms, and in typical applications, this can often be the case. As an example, a 5 dB attenuator connected at coupled port 23 would improve the return loss at matched coupled port 27 of the directional coupler by 10 dB. Conversely, the use of an attenuator in the manner shown in FIG. 2B ensures that, regardless of the termination at matched coupled port 27, the impedance presented to the coupled pair of transmission lines 25 is close to the required reference impedance and thus that the conditions of EQUATION 1 are met.

The attenuator 28 at the isolated port 24 of FIG. 2B is provided for symmetry, i.e. if the directional coupler is to be used in reverse, with power being fed to direct port 22 and power being coupled to isolated port 24. The attenuator 28 at isolated port 24 will minimize the effect of any mismatch which may be connected at isolated port 24. Attenuators 26, 28 do not significantly affect the insertion loss of the directional coupler of FIG. 2B. Attenuator 26 gives rise to a reduction in the coupling ratio; however, compensation for this effect is possible by re-design of the pair of coupled transmission lines for higher coupling. As an example, it can be seen from TABLE 1 that for directional couplers providing coupling ratios of less than −15 dB, compensation for the addition of a 5 dB attenuator at the coupled port will produce a degradation of 0.32 dB or less in the insertion loss of the directional coupler.

TABLE 1

Theoretical Minimum Insertion Loss of a Directional Coupler for a given Coupling Ratio.

| Percentage of Input Power fed to Coupled Port | Relative Power fed to Coupled Port/dB | Theoretical Minimum Insertion Loss |
|---|---|---|
| 50% | −3.0 dB | −3.0 dB |
| 25% | −6.0 dB | −1.25 dB |
| 10% | −10 dB | −0.46 dB |
| 3% | −15 dB | −0.14 dB |
| 1% | −20 dB | −0.04 dB |
| 0.3% | −25 dB | −0.01 dB |

FIG. 3 shows a block diagram of part of the TX section of a prior art RF front-end circuit which includes a directional coupler and other components to monitor power levels emitted from the power amplification stage and to monitor power levels reflected from the antenna. A percentage of the RF power emitted by the power amplifier (PA) is fed via the directional coupler to the first power detector so that the level of power emitted by the PA can be monitored. Similarly, a percentage of the RF power reflected back into the circuit by the antenna is fed via the directional coupler to the second power detector. Hence, the directional coupler in the circuit of FIG. 3 facilitates independent monitoring of the RF power emitted by the PA and the RF power reflected by the antenna. However, independent monitoring of these two power levels requires that the isolation of the directional coupler is sufficiently high to prevent a significant percentage of the signal emitted from the PA being fed directly to the $2^{nd}$ power detector. Specifically, for a capability to measure two substantially different power levels emitted by the PA and reflected by the antenna (say a difference of 20 dB), the directional coupler is typically required to have a very high directivity E.G. 25 dB or higher.

From the description of the prior art provided above, it is clear that for RF power monitoring applications, a directional coupler is required to be compact, and to offer high directivity.

Significant problems in the design and fabrication of directional couplers arise from the limitations in the accuracy and control over the fabrication of transmission lines with the required physical dimensions. Similar problems arise due to the limitations in the consistency of the material properties of the substrate on which the transmission lines are fabricated and batch variations in the thickness of the substrate. These limitations influence the capability to fabricate a coupler which meets the conditions of EQUATION 1. Furthermore, in the design of a directional coupler, the choice of available substrates is also limited to a few materials and a few discrete substrate thicknesses.

The drive for greater miniaturization is another limiting factor: the realization of a directional coupler with sufficiently small outer dimensions typically demands transmission lines that have physical dimensions which may be outside the capability of the fabrication process. For example, fabrication of a directional coupler on a thin substrate allows a reduction in the height of the coupler, and the use of a substrate with a high dielectric constant allows for reduction in the length of the coupled transmission lines of the coupler for a given coupling ratio. However, the use of a thin substrate will lower the even mode impedance of the coupled transmission lines, and the use of a substrate with a high dielectric constant will lower both the even mode impedance and the odd mode impedances of the coupled lines.

It is possible to compensate for the reduction in the even mode impedance by using narrower transmission lines; however the design rules of the production process typically sets a lower limit on the dimensions of lines. On the other hand, it is possible to compensate for a low odd mode impedance arising from the use of a substrate with a high dielectric constant by designing a coupler with transmission lines which are spaced further apart; unfortunately, increasing the spacing between the transmission lines lowers the coupling ratio of the directional coupler, and the only way to compensate for a lower coupling ratio is to use longer transmission lines thereby canceling any the benefit of selecting a high dielectric substrate for miniaturization.

In summary, the designer of a miniaturized directional coupler is faced with the dilemma that dimensions of the coupled transmission lines, and the electrical properties of the material of the substrate determine the even mode impedance and the odd mode impedance of the directional coupler, but that the product of the even mode impedance and the odd mode impedance of the directional coupler must equal the square of the reference impedance according to EQUATION 1—$2500\Omega^2$ for conventional RF applications. Hence, the designer is presented with a limited range of options to produce a directional coupler of the required size with the required performance and which can be fabricated to the required precision.

To overcome these problems, the designer needs an additional degree of freedom when selecting line widths and line spacing for producing a miniaturised directional coupler.

As mentioned previously, it has been well established in the design of a directional coupler, where high directivity is a goal, that the product of the even mode impedance and the odd mode impedance should be equal to the square of the reference impedance—see EQUATION 1. This condition, while valid, does not provide the most general requirement.

Referring once again to FIG. 2A, the most general requirement for the design of a directional coupler with high directivity is that the product of the impedance terminating the direct port 22 and the impedance terminating the coupled port 23 should be equal to the product of the even mode impedance $Z_{0E}$ and the odd mode impedance $Z_{0O}$ of the coupled transmission lines. This relationship is given by EQUATION 2

$$Z_{P2} \times Z_{P3} = Z_{OO} \times Z_{OE} \qquad \text{EQUATION 2}$$

where $Z_{P2}$ is the value of the impedance terminating the direct port 22 and where $Z_{P3}$ is the value of the impedance terminating the coupled port 23.

In practical use, the impedance terminating the direct port of a directional coupler $Z_{P2}$ will invariably be the reference impedance. In fact, the assumption that the reference impedance terminates all ports of a directional coupler is the starting point in most technical analyses on the subject. However, it is possible to transform the impedance terminating the coupled port using an impedance transformation circuit. One example of a circuit which can provide impedance transformation is a resistive attenuator, such as a PI-type resistive attenuator. Conveniently, as described above and as illustrated in FIG. 2B a resistive attenuator can be used advantageously in a directional coupler to provide matching of a poor or unknown termination at the coupled port. However, a resistive attenuator may also be used to provide impedance transformation of a reference impedance to some other value.

FIG. 4 shows an exemplary drawing of a prior art PI-type attenuator circuit which can provide both impedance matching and attenuation and which can also provide impedance transformation. The level of attenuation and the impedance transformation ratio of the circuit of FIG. 4 is determined by the values of resistors R41, R42, and R43.

SUMMARY OF THE INVENTION

The present invention to provide a directional coupler according to claim 1.

Preferably, the directional coupler includes an impedance matching and impedance transforming attenuator connected at the third RF port which provides a level of attenuation and, moreover, which transforms a reference impedance value $Z_0$ to a transformed impedance value $Z_{P3}$ not equal to $Z_0$ and given by the following equation:

$$Z_{P3} = \frac{Z_{00} \times Z_{0E}}{Z_0} \qquad \text{EQUATION 3}$$

Preferably the product of the even mode impedance and odd mode impedance of the pair coupled transmission lines of the present invention has a value that is less than the square of the standard reference impedance for RF devices—i.e. less than $2500\Omega^2$, so that transformed impedance value $Z_{P3}$ is less than a reference impedance value $Z_0$.

BRIEF DESCRIPTION OF THE DRAWINGS

Embodiments of the invention will now be described, by way of example, with reference to the accompanying drawings, in which.

DESCRIPTION OF THE PREFERRED EMBODIMENTS

Figure 1:
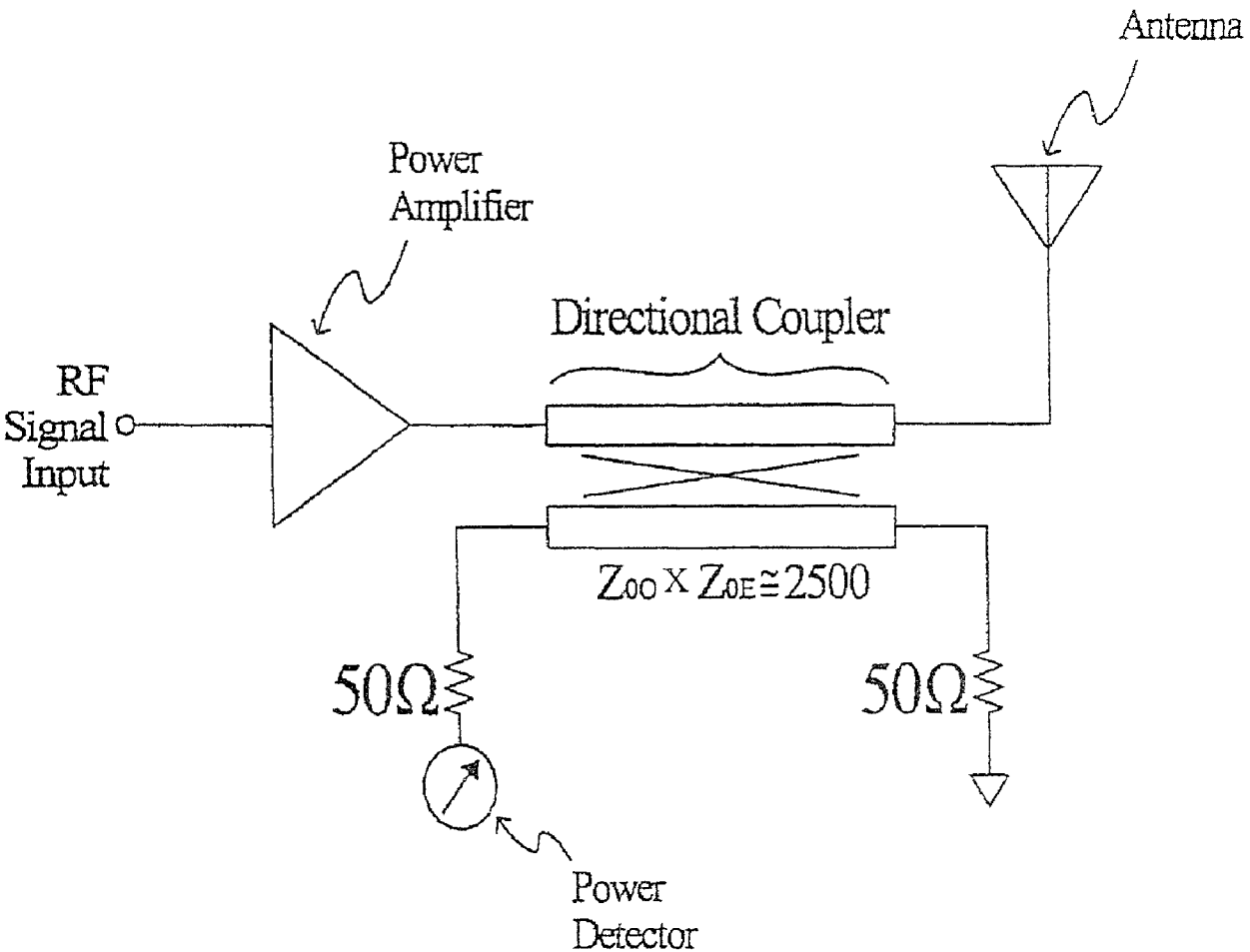
Figure 1 (Prior Art)
FIG. 1 shows a block diagram of a prior art RF front-end circuit employing a directional coupler for power monitoring.
Figure 2A:
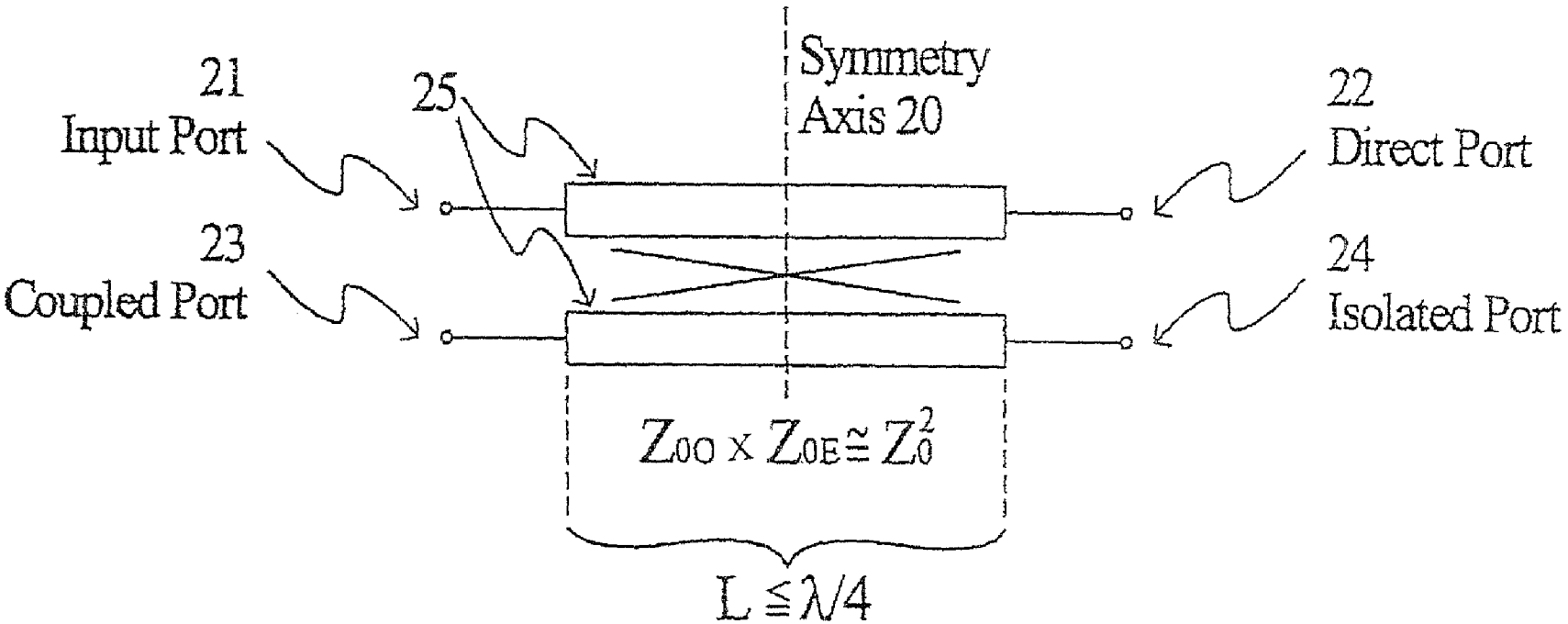
Figure 2A (Prior Art)
FIG. 2A shows a diagram of a prior art directional coupler comprising a pair of electromagnetically coupled transmission lines and 4 input/output ports.
Figure 2B:
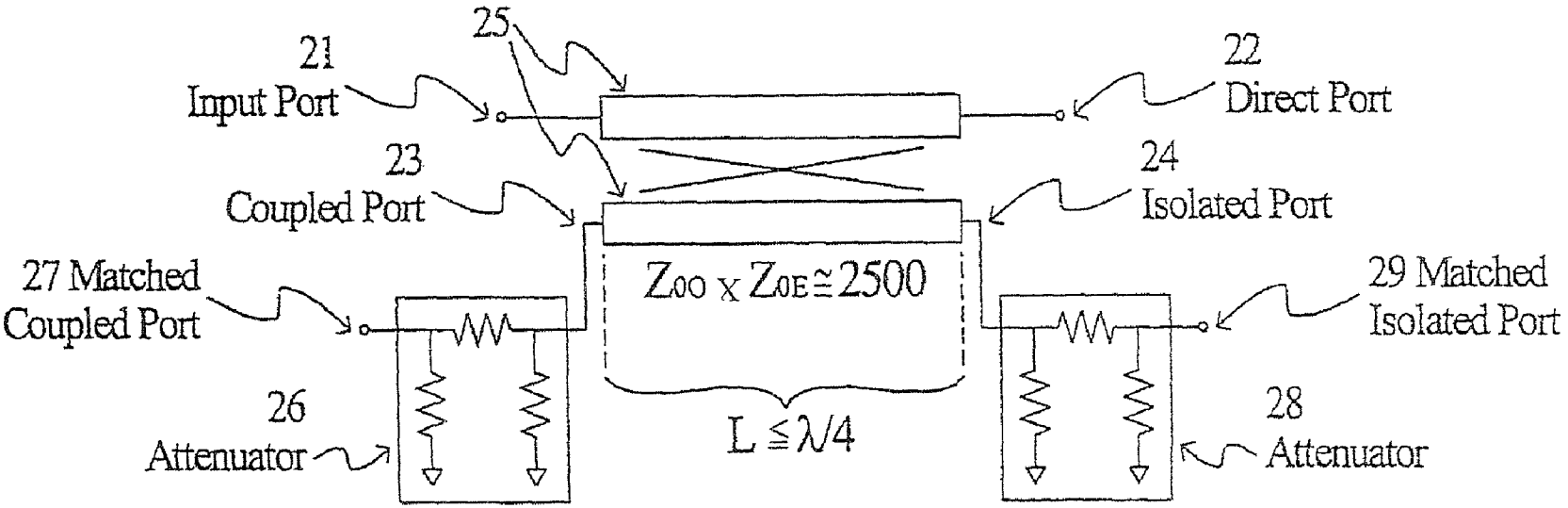
Figure 2B (Prior Art)
FIG. 2B shows a circuit diagram of a prior art directional coupler with attenuators added at the coupled port and at the isolated port.
Figure 3:
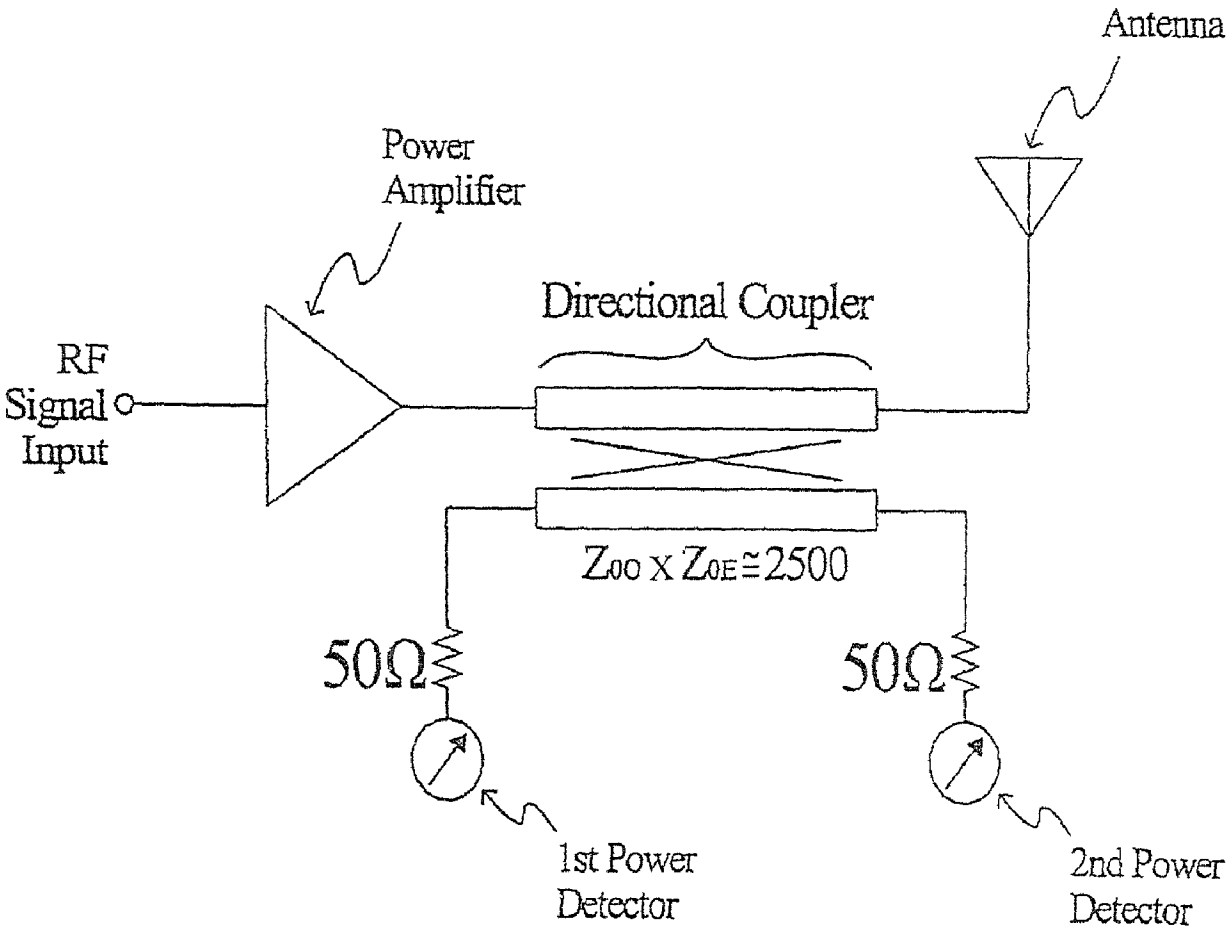
Figure 3 (Prior Art)
FIG. 3 shows a block diagram of a prior art RF front-end circuit employing a directional coupler with separate monitoring of PA output power and reflected power.
Figure 4:
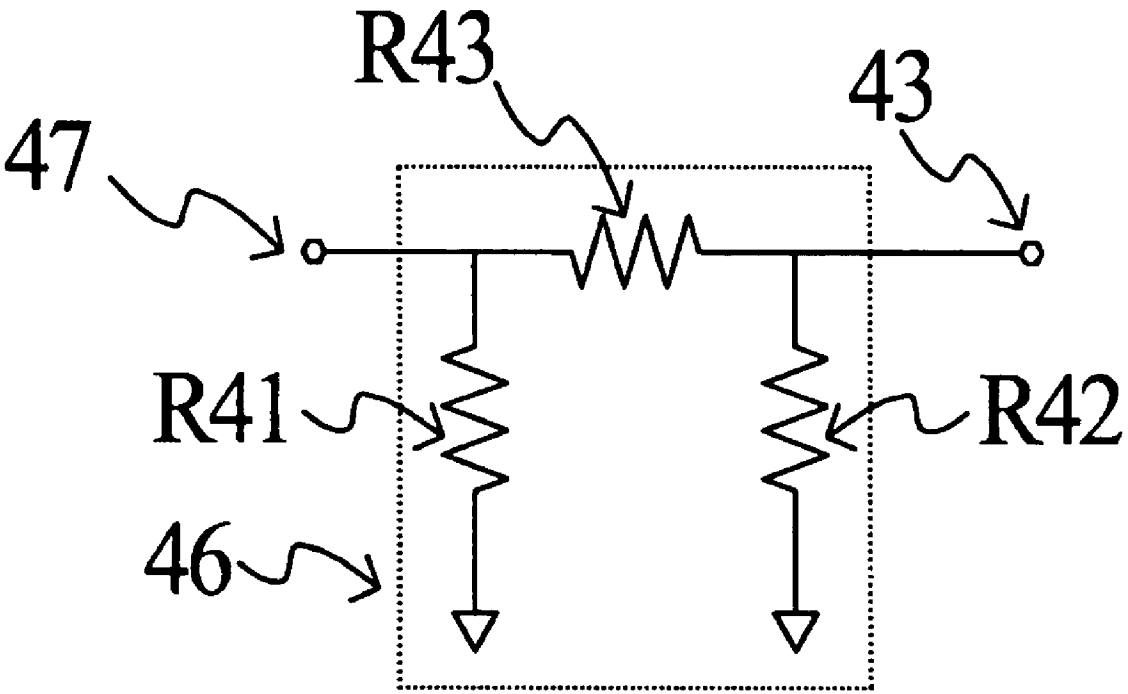
Figure 4 (Prior Art)
FIG. 4 shows a circuit diagram of a prior art PI-type resistive attenuator, which can provide impedance transformation.
Figure 5:
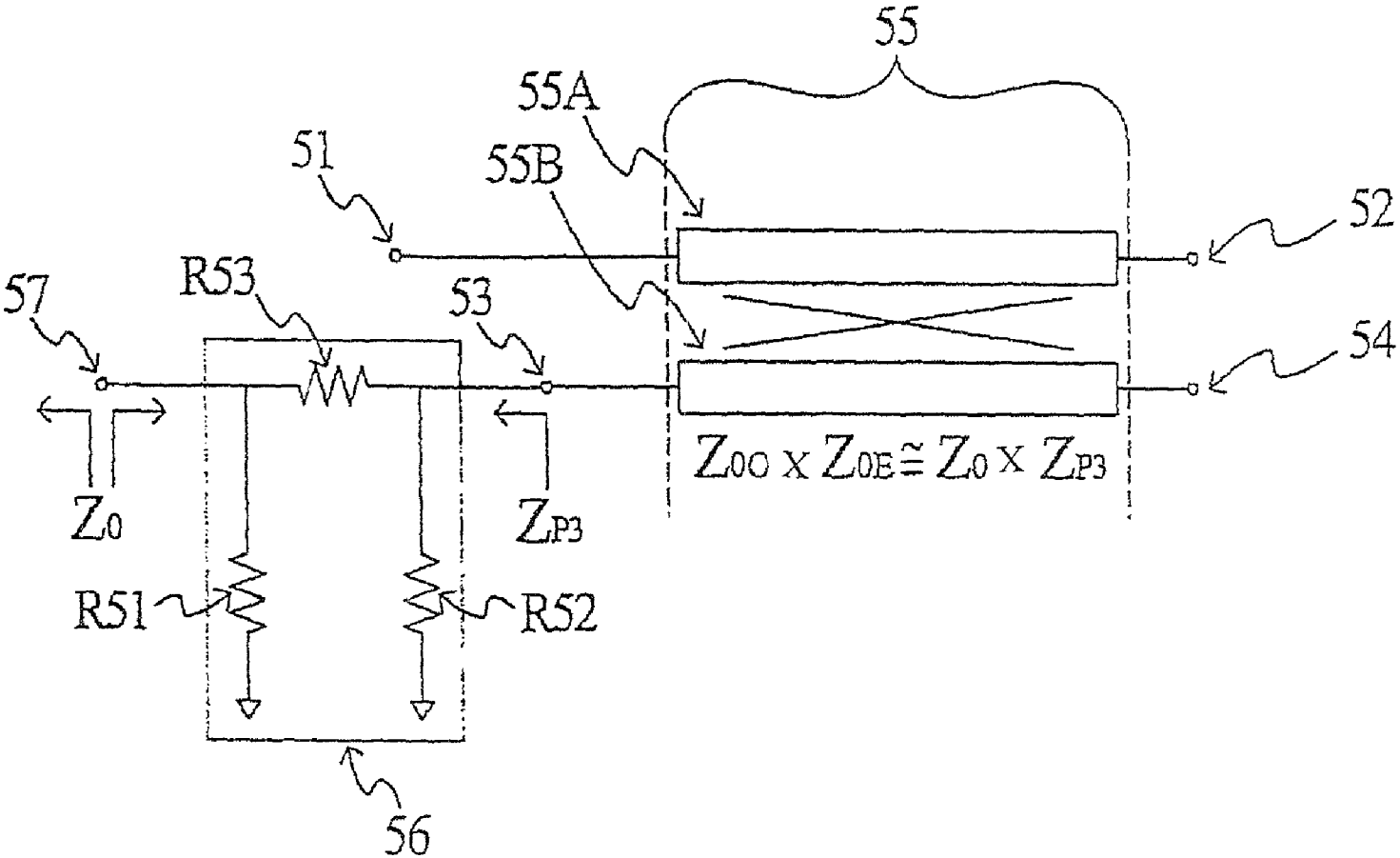
FIG. 5 shows a circuit diagram of a directional coupler according to the present invention including an impedance matching and impedance transforming attenuator according to a first embodiment of the present invention.

FIG. 5 shows a circuit diagram of a directional coupler according to a first embodiment of the present invention comprising a pair of coupled transmission lines 55, the pair of transmission lines 55 being located in close proximity to each other so that they are electromagnetically coupled to each other. The pair of coupled transmission lines 55 comprises a first transmission line 55A and a second transmission line 55B where the first transmission line 55A comprises a first end, to which a first RF port 51 is connected, and a second end, to which a second RF port 52 is connected, and where the second transmission line 55B comprises a first end, to which a third RF port 53 is connected, and a second end, to which a fourth RF port 54 is connected. An input electrical signal that is fed to first RF port 51 will produce a direct electrical signal at second RF port 52, and a coupled RF signal at third RF port 53. Under ideal operating conditions, the same input signal will produce no signal (or a negligibly small signal) at fourth RF port 54. The pair of coupled transmission lines can be characterized by an even mode impedance and odd mode impedance of the coupled transmission lines, where the values of the even mode impedance and the odd mode impedance are determined by the physical dimensions of the pair of coupled transmission lines 55 and the electrical properties of the materials between and surrounding the pair of coupled transmission lines 55. The material of the pair coupled transmission lines also has an effect on the impedances but this effect is small provided that the pair of coupled transmission lines are fabricated from a material that is a good electrical conductor at the frequency of operation of the directional coupler. Preferably, the dimensions of the pair of coupled transmission lines and properties of the materials between and surrounding them are selected to enable easy fabrication and miniaturization of the directional coupler.

The directional coupler of FIG. 5 of the present invention further includes a two terminal impedance matching and impedance transforming attenuator 56 with one terminal thereof connected to third RF port 53 and with another terminal thereof forming a fifth RF port 57. Impedance matching and impedance transforming attenuator 56 provides a level of attenuation and, moreover, transforms the reference impedance value $Z_0$ (typically 50 Ohms) to a transformed impedance value $Z_{P3}$ given by EQUATION 3.

Preferably the product of the even mode impedance and odd mode impedance of the pair coupled transmission lines 55 of the present invention has a value that is less than the square of the standard reference impedance for RF devices—ie less than $2500\Omega^2$—so that the transformed impedance value $Z_{P3}$ is less than 50 Ohms, and preferably less than 45 Ohms, or 10% less than the reference impedance, so enabling a commensurate increase in the width of one or both of the transmission lines 55A, 55B.

The directional coupler of the present invention has 4 input/output ports as follows: first RF port 51, which can be labeled as the input port of the directional coupler; second RF port 52, which can be labeled as the direct port of the directional coupler; fifth RF port 57, which can be labeled as the coupled port of the directional coupler; and fourth RF port 54 which can be labeled as the isolated port of the directional coupler.

In FIG. 5, the impedance matching and impedance transforming attenuator 56 comprises a PI network, however, as will be described later, it could equally comprise a T network.

Preferably the impedance matching and impedance transforming attenuator 56 comprises three resistors, a first shunt resistor R51 connected to input/output port 57 of the directional coupler, a second shunt resistor R52 connected to third RF port 53 and a series resistor R53 with one terminal connected to third RF port 53 and another terminal connected to input/output port 57 of the directional coupler.

The respective values of resistors R51, R52, and R53 are given by EQUATIONS 4a, 4b, 4c and 4d below, where ATT is the attenuation of impedance matching and impedance transforming attenuator 56.

$$R_{53} = \frac{(k-1)}{2}\sqrt{\frac{Z_0 Z_{P3}}{k}} \qquad \text{EQUATION 4a}$$

$$\frac{1}{R_{52}} = \frac{(k+1)}{Z_{P3}(k-1)} - \frac{1}{R_{53}} \qquad \text{EQUATION 4b}$$

$$\frac{1}{R_{51}} = \frac{(k+1)}{Z_0(k-1)} - \frac{1}{R_{53}} \qquad \text{EQUATION 4c}$$

$$k = 10^{\frac{ATT}{10}} \qquad \text{EQUATION 4d}$$

The arrangement of the pair of coupled transmission lines 55, with impedance matching and impedance transforming attenuator 56 in the present invention is such that the directional coupler is matched to the reference impedance $Z_0$ at all input/output ports 51, 52, 57 and 54, while, at the same time, the designer has the option to choose a low value for the product of the even mode impedance $Z_{0E}$ and the odd mode impedance $Z_{0O}$ of the pair of coupled transmission lines 55 so as to facilitate easy fabrication and miniaturization.

Specifically, the arrangement of the pair of coupled transmission lines 55, with impedance matching and impedance transforming attenuator 56 in the present invention is such that the designer has the option to select a pair of coupled transmission lines 55, where the constituent lines 55A and 55B are wider than would be required in order that the criteria of EQUATION 1 be met.

The use of wider lines reduces the product of the even mode impedance and the odd mode impedance of the pair of coupled transmission lines 55, however the designer can correct for this effect by a suitable choice of the impedance $Z_{P3}$, and corresponding suitable values of resistors R51, R52 and R53 in order that the criteria of EQUATION 3 be met. The use of wider transmission lines 55A and 55B for the directional coupler of the present invention has a number of benefits for mass production: wider lines are easier to fabricate, which may enable the process or result in a lower cost process; wider lines are less affected by variations in mass production process; wider lines are less affected by misalignment of layers for broadside coupled lines. Moreover, wider lines offer higher coupling, which can be of benefit to the designer when trying to produce a lineup of directional couplers offering a range of coupling ratios.

Figure 6B:
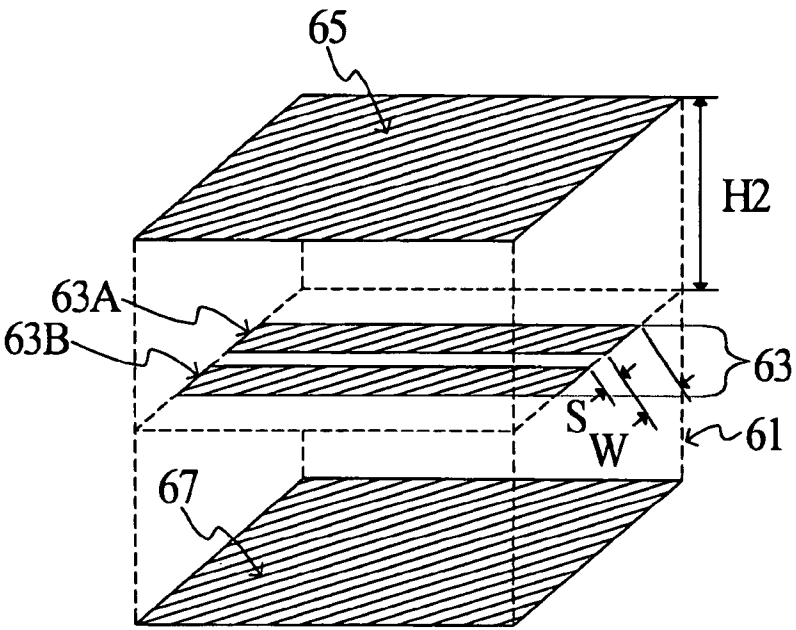
Figure 6B (Prior Art)
FIG. 6B shows a 3 dimensional drawing of a prior art structure comprising a pair of edge coupled transmission lines.
Figure 6A:
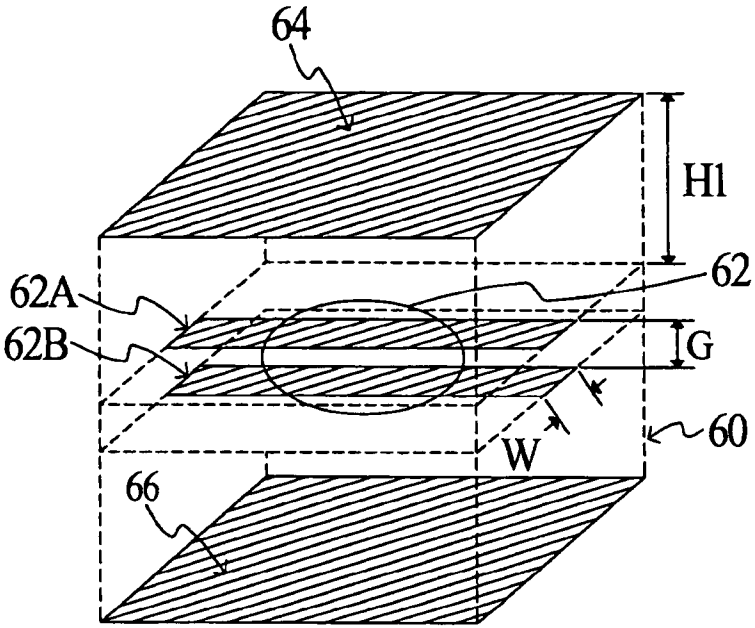
Figure 6A (Prior Art)
FIG. 6A shows a 3 dimensional drawing of a prior art structure comprising a pair of broadside coupled transmission lines.

FIG. 6A shows a 3 dimensional drawing of a pair of broadside coupled transmission lines 62 comprising first transmission line 62A and second transmission line 62B, where first and second transmission lines 62A and 62B are fabricated in an insulating substrate 60. Substrate 60 may, for example, be constructed of several insulating layers which are stacked and which are formed into a block as part of the production process. Electromagnetic coupling between the pair of coupled transmission lines 62 takes place primarily between the adjacent faces of the first and second transmission lines 62A and 62B. Metal ground planes 64 and 66 are typically (but not necessarily) fabricated above and below the pair of coupled transmission lines or a single ground plane may be provided above 64 or below 66 the pair of coupled transmission lines 62. The distance H1 from the pair of coupled transmission lines 62 to the nearest ground plane and the widths W of the coupled transmission lines are critical parameters in determining the even mode impedance of the pair of coupled transmission lines. The gap G between the adjacent faces of the pair of coupled transmission lines 62 and the widths W of the coupled transmission lines are critical parameters in determining the coupling between the lines and the odd mode impedance of the pair of coupled transmission lines. The coupled transmission lines 55 of the embodiment of the present invention depicted in FIG. 5 may, for example, be formed as a pair of broadside coupled transmission lines, such as is shown in FIG. 6A.

For a directional coupler comprising a pair of broad side coupled transmission lines as depicted in FIG. 6A, it is often preferable for the designer to use a pair of coupled transmission lines 62, where the first transmission line 62A is wider than the second transmission line 62B (or vice versa). This design choice reduces the effects of misalignment error in the mass production of the directional coupler, but also has the effect of lowering the product of the even-mode impedance and the odd mode impedance of the pair of coupled transmission lines. Nonetheless, according to present invention, the effect of the lowered impedance product can be corrected by a suitable choice of the impedance matching and impedance transforming attenuator so that the product of the even mode impedance $Z_{0E}$ and odd mode impedance $Z_{0O}$ of the coupled transmission lines, the value of the reference impedance $Z_0$, and the value of the transformed impedance $Z_{P3}$, are in agreement with EQUATION 3.

FIG. 6B shows a 3 dimensional drawing of a pair of edge coupled transmission lines 63 comprising first metal transmission line 63A and second metal transmission line 63B, where first and second transmission lines 63A and 63B are fabricated in an insulating substrate 61. The electromagnetic coupling between the pair of transmission lines takes place primarily between the two adjacent edges of the pair of coupled transmission lines. Metal ground planes 65 and 67 may be fabricated above and/or below the pair of coupled transmission lines 63. The distance H2 from the pair of coupled transmission lines 63 to the nearest ground plane and the widths W of the coupled transmission lines are critical parameters in determining the even mode impedance of the pair of coupled transmission lines. The spacing S between the first and second transmission lines 63A and 63B is a critical parameter in determining the coupling between the lines, and similarly the odd mode impedance of the coupled transmission lines. The pair of coupled transmission lines 55 of the embodiment of the present invention depicted in FIG. 5 may, for example, be formed as a pair of edge coupled transmission lines, such as is shown in FIG. 6B.

Figure 7:
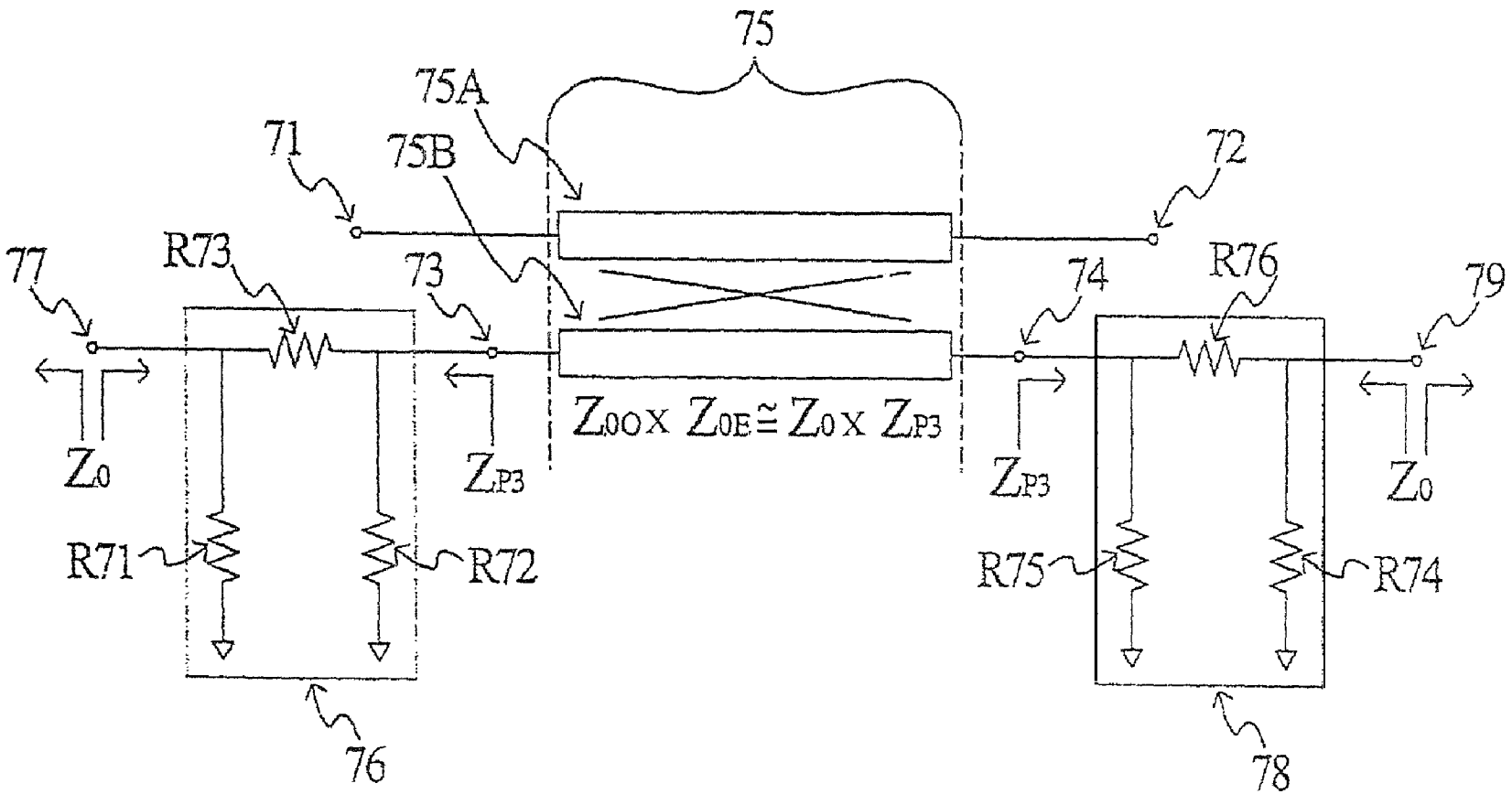
FIG. 7 shows a circuit diagram of a symmetrical directional coupler according to the present invention including a pair of impedance matching and impedance transforming attenuators according to a second embodiment of the present invention.

FIG. 7 shows a circuit diagram of a directional coupler according to a second embodiment of the present invention comprising a pair of coupled transmission lines 75, the pair of transmission lines 75 being located in close proximity to each other so that they are electromagnetically coupled to each other. The pair of coupled transmission lines 75 comprises a first transmission line 75A and a second transmission line 75B where the first transmission line 75A comprises a first end, to which a first RF port 71 is connected, and a second end, to which a second RF port 72 is connected, and where the second transmission line 75B comprises a first end, to which a third RF port 73 is connected, and a second end, to which a fourth RF port 74 is connected. An input electrical signal that is fed to first RF port 71 will produce a direct electrical signal at second RF port 72, and a coupled RF signal at third RF port 73; under ideal operating conditions, the same input signal will produce no signal (or a negligibly small signal) at fourth RF port 74. As for the first embodiment depicted in FIG. 5, the pair of coupled transmission lines can be characterized by an even mode impedance and odd mode impedance of the coupled transmission lines, where the values of the even mode impedance and the odd mode impedance are determined by the physical dimensions of the pair of coupled transmission lines 75 and the electrical properties of the materials between and surrounding the pair of coupled transmission lines 75. Preferably, these dimensions and properties are selected to enable easy fabrication and miniaturization of the directional coupler.

The directional coupler of FIG. 7 of the present invention further includes a pair of two terminal impedance matching and impedance transforming attenuators 76, 78 with one terminal of impedance transformation attenuator 76 connected to third RF port 73 and with another terminal thereof forming a fifth RF port 77; similarly, one terminal of impedance transformation attenuator 78 is connected to fourth RF port 74 and another terminal thereof forms a sixth RF port 79 of the directional coupler. Impedance matching and impedance transforming attenuator 76 provides a level of attenuation and, moreover, transforms the reference impedance value $Z_0$ (typically 50 Ohms) to a transformed impedance value $Z_{P3}$ given by EQUATION 3. Similarly, impedance transforming attenuator 78 provides a level of attenuation and, moreover, transforms the reference impedance value $Z_0$ (typically 50 Ohms) to a transformed impedance value $Z_{P4}$. Preferably, $Z_{P4}$ is equal to $Z_{P3}$.

Preferably the product of the even mode impedance and odd mode impedance of the pair coupled transmission lines 75 of the present invention has a value that is less than the square of the standard reference impedance for RF devices—ie less than $2500\Omega^2$—so that the transformed impedance value $Z_{P3}$ is less than 50 Ohms, and preferably less than 45 Ohms, or 10% less than the reference impedance, so enabling a commensurate increase in the width of one or both of the transmission lines 75A, 75B.

The directional coupler of FIG. 7 has 4 input/output ports as follows: first RF port 71, which can be labeled as the input port of the directional coupler; second RF port 72, which can be labeled as the direct port of the directional coupler; fifth RF port 77, which can be labeled as the coupled port of the directional coupler; and sixth RF port 79 which can be labeled as the isolated port of the directional coupler.

In FIG. 7, the impedance matching and impedance transforming attenuators 76 and 78 comprise respective PI networks, however, as will be described later, they could equally comprise a T network.

Preferably impedance matching and impedance transforming attenuator 76 comprises three resistors, a first shunt resistor R71 connected to input/output port 77 of the directional coupler, a second shunt resistor R72 connected to third RF port 73 and a series resistor R73 with one terminal connected to third RF port 73 and another terminal connected to input/output port 77 of the directional coupler.

The respective values of resistors R71, R72, and R73 are given by EQUATIONS 4a, 4b, 4c and 4d above.

A similar arrangement describes impedance matching and impedance transforming attenuator 78.

Figure 12:
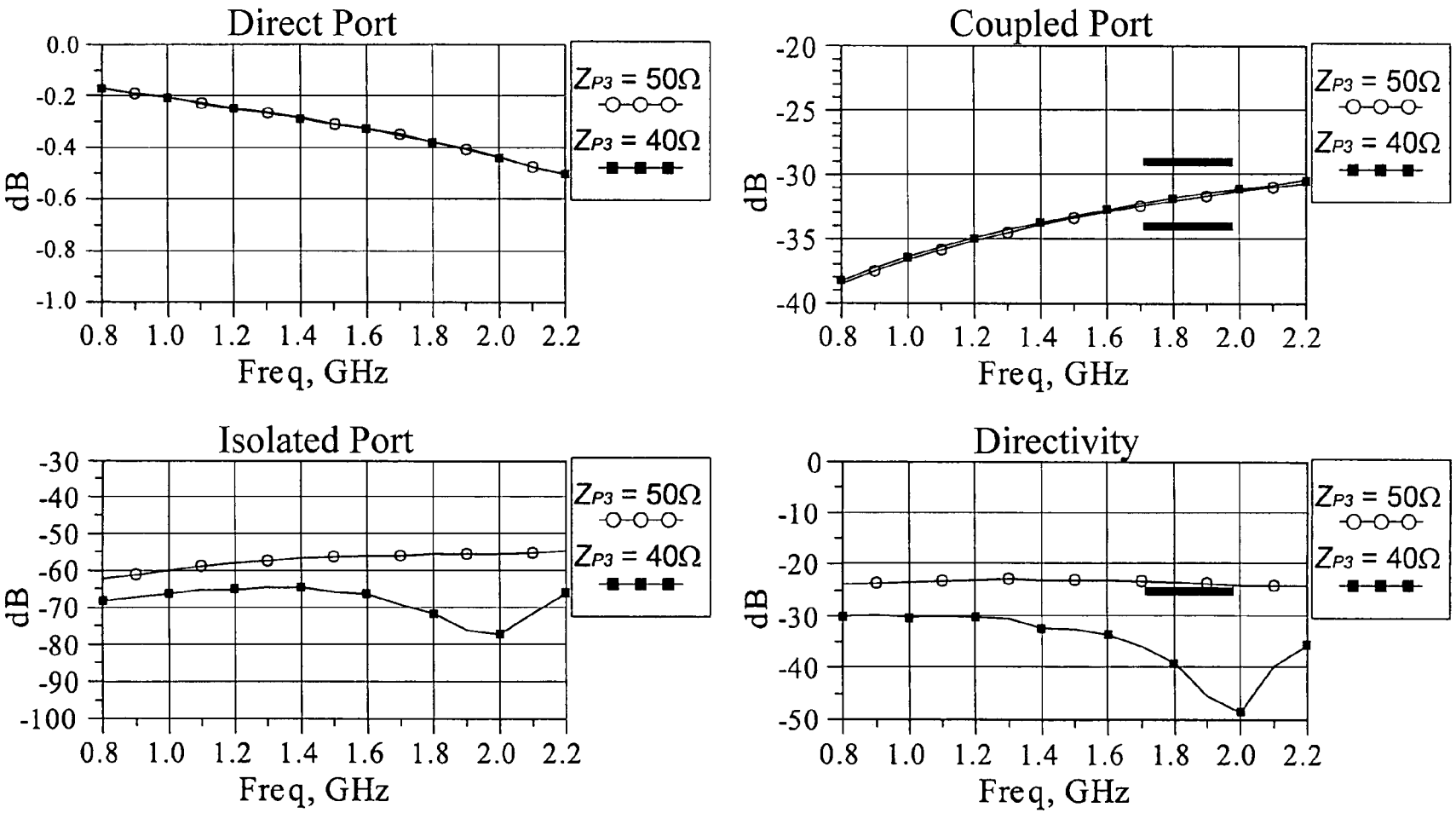
FIG. 12 shows a comparison of four performance plots of a directional coupler according to FIG. 7 for two values of the impedance $Z_{P3}$. and showing that the isolation of the directional coupler is optimum when $Z_{P3}$.=40Ω.

FIG. 12 shows a comparison of four performance plots of a manufactured directional coupler according to FIG. 7 where the widths of the pair of coupled transmission lines 75 were selected to suit the tolerances of the manufacturing process and with increased widths compared with a directional coupler designed to satisfy the criteria of EQUATION 1. Two alternative versions of this directional coupler were produced: one with a conventional impedance matching attenuator connected at third RF port 73, thus providing an impedance of 50Ω at third RF port 73 and a second with an impedance matching and impedance transforming attenuator 76 connected at third RF port 73 which transforms an impedance of 50Ω at fifth RF port 77 providing a transformed impedance $Z_{P3}$ of 40Ω at third RF port 73. It can be seen that the isolation and directivity of the second directional coupler (i.e. when $Z_{P3}$.=40Ω) are both improved when compared with the first.

Figure 8:
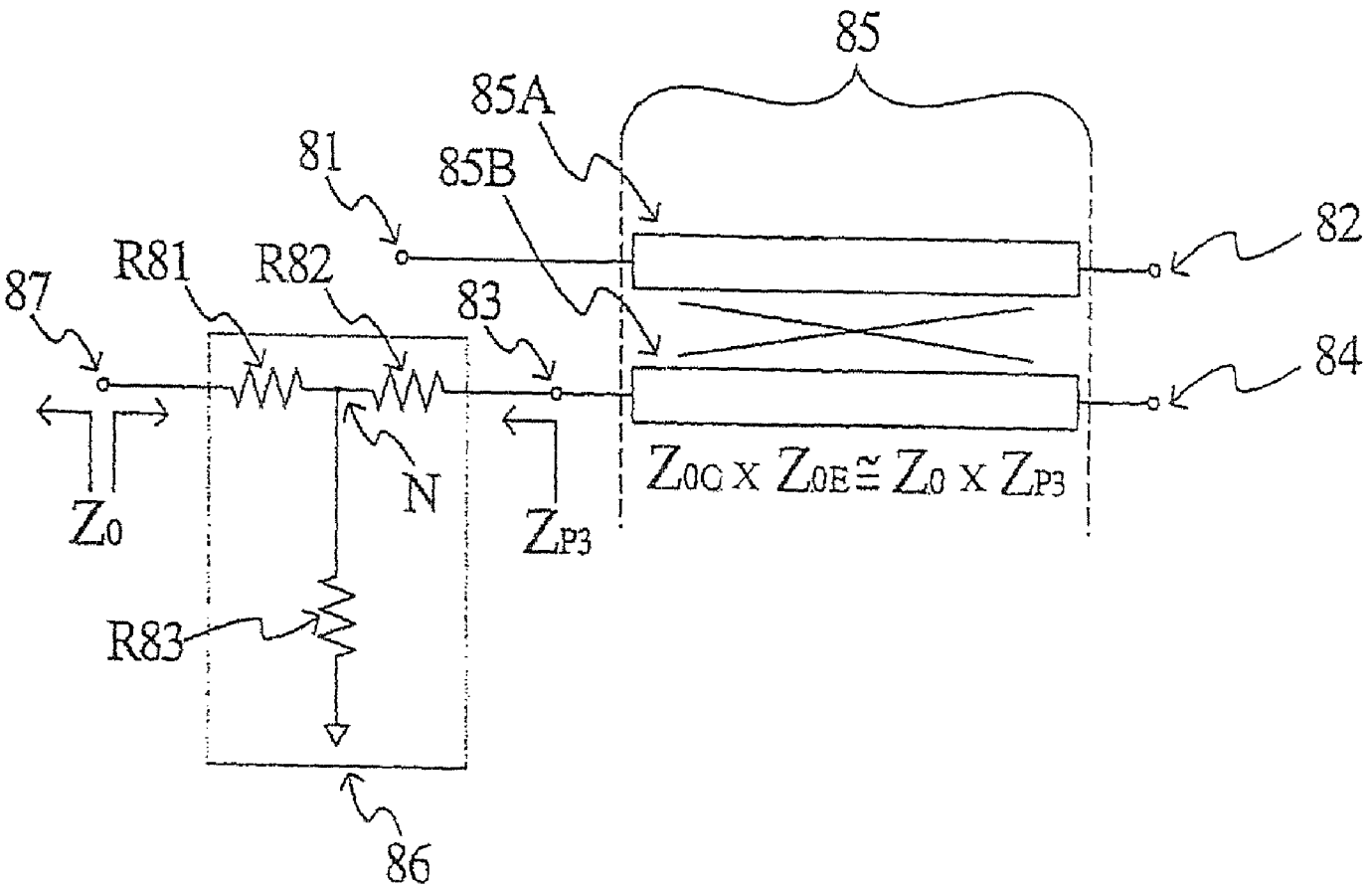
FIG. 8 shows a circuit diagram of a directional coupler according to the present invention including an impedance matching and impedance transforming attenuator according to a third embodiment of the present invention.

FIG. 8 shows a circuit diagram of a directional coupler according to a third embodiment of the present invention comprising a pair of coupled transmission lines 85, the pair of transmission lines 85 being located in close proximity to each other so that they are electromagnetically coupled to each other. The pair of coupled transmission lines 85 comprises a first transmission line 85A and a second transmission line 85B where first transmission line 85A comprises a first end, to which a first RF port 81 is connected, and a second end, to which a second RF port 82 is connected, and where second transmission line 85B comprises a first end, to which a third RF port 83 is connected, and a second end, to which a fourth RF port 84 is connected. An input electrical signal that is fed to first RF port 81 will produce a direct electrical signal at second RF port 82, and a coupled RF signal at third RF port 83; under ideal operating conditions, the same input signal will produce no signal (or a negligibly small signal) at fourth RF port 84. The pair of coupled transmission lines can be characterized by an even mode impedance and odd mode impedance of the coupled transmission lines, where the values of the even mode impedance and the odd mode impedance are determined by the physical dimensions of the pair of coupled transmission lines 85 and the electrical properties of the materials surrounding and between coupled transmission lines 95. Preferably, these dimensions and properties are selected to enable easy fabrication and miniaturization of the directional coupler.

The directional coupler of FIG. 8 of the present invention further includes a two terminal impedance matching and impedance transforming attenuator 86 with one terminal thereof connected to third RF port 83 and with another terminal thereof forming a fifth RF port 87 of the directional coupler. Impedance matching and impedance transforming attenuator 86 provides a level of attenuation and, moreover, transforms the reference impedance value $Z_0$ (typically 50 Ohms) to a transformed impedance value $Z_{P3}$ given by EQUATION 3.

Preferably the product of the even mode impedance and odd mode impedance of the pair coupled transmission lines 85 of the present invention has a value that is less than the square of the standard reference impedance for RF devices—ie less than $2500\Omega^2$—so that the transformed impedance value $Z_{P3}$ is less than 50 Ohms, and preferably less than 45 Ohms, or 10% less than the reference impedance, so enabling a commensurate increase in the width of one or both of the transmission lines 85A, 85B.

The directional coupler of FIG. 8 of the present invention has 4 input/output ports as follows: first RF port 81, which can be labeled as the input port of the directional coupler; second RF port 82, which can be labeled as the direct port of the directional coupler; fifth RF port 87, which can be labeled as the coupled port of the directional coupler; and fourth RF port 84 which can be labeled as the isolated port of the directional coupler.

Impedance matching and impedance transforming attenuator 86 of FIG. 8 comprises a T network in this case comprising three resistors, a first series resistor R81 with a first terminal thereof connected to input/output port 87 of the directional coupler, a second series resistor R82 with a first terminal thereof connected to third RF port 83 where the second terminals of said first and second series resistors R81 and R82 are connected together at a common node N. Impedance matching and impedance transforming attenuator 86 further comprising a shunt resistor R83 which is connected to common node N.

The values of first series resistor R81, second series resistor R82 and shunt resistor R83 are given by equations 5a-5d, and preferably the value of $Z_{P3}$ is less than that of $Z_0$.

$$R_{83} = \frac{2\sqrt{kZ_0Z_{P3}}}{(k-1)} \quad \text{EQUATION 5a}$$

$$R_{82} = \frac{(k+1)}{(k-1)}Z_{P3} - R_{83} \quad \text{EQUATION 5b}$$

$$R_{81} = \frac{(k+1)}{(k-1)}Z_0 - R_{83} \quad \text{EQUATION 5c}$$

$$k = 10^{\frac{ATT}{10}} \quad \text{EQUATION 5d}$$

Figure 9:
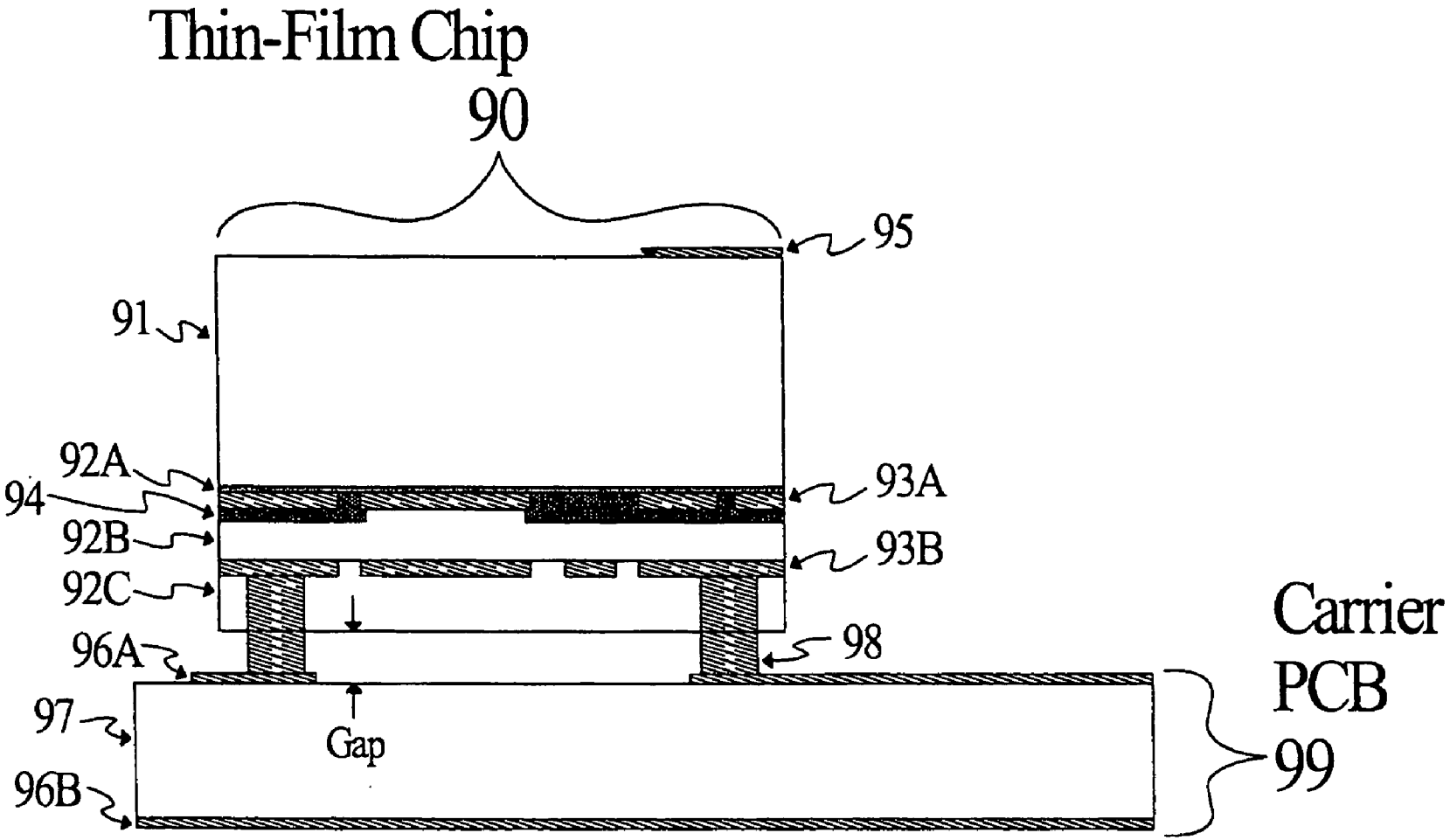
FIG. 9 shows a cross section drawing of a thin-film structure to be used in the fabrication of a directional coupler with integrated matching and impedance transformation.

FIG. 9 shows a cross section of thin-film structure which is, for example, suitable for a physical implementation of the embodiments of the directional couplers of the present invention described herein. The structure comprises a thin-film chip 90 with a first surface including multiple thin layers fabricated thereon where thin-film chip 90 is mounted on a carrier PCB 99, comprising a substrate layer 97 sandwiched between two metal or electrically conductive layers 96A, 96B. In the exemplary drawing of FIG. 9, thin-film chip 90 is mounted so that the first surface of the chip faces carrier PCB 99—i.e. faces downwards in FIG. 9. Thin-film chip 90 comprises a base substrate 91 formed of an insulating material with high Q at RF frequencies (E.G. Alumina or high Q Silicon). Thin layers are fabricated on the first surface of thin film chip 90 as follows: first insulation layer 92A fabricated firstly on the first surface of thin-film chip 90; first metal layer 93A fabricated secondly on the first surface of thin-film chip 90; resistive film layer 94 fabricated thirdly on the first surface of thin-film chip 90; second insulation layer 92B fabricated fourthly on the first surface of thin-film chip 91; second metal layer 93B fabricated fifthly on the first surface of thin-film chip 91; third insulation layer 92C fabricated sixthly on the first surface of thin-film chip 90. First insulation layer 92A is provided as a barrier to protect base substrate 91 from the effects of the fabrication of the subsequent layers. During the fabrication process each of first metal layer 93A, resistive film layer 94, second insulation layer 92B, second metal layer 93B and third insulation layer 92C are patterned to provide the required electrical properties of a directional coupler according to the present invention. Electrically conducting pads 98 protrude from the top of thin-film chip 90 so as to provide electrical contact between carrier PCB 99 and thin-film chip 90. Electrically conducting pads 98 are fabricated so as to produce a specific gap between thin-film chip 90 and carrier PCB 99 after mounting and assembly.

The metal layer 96B of carrier PCB 99 which is furthest from thin-film chip 90 typically is connected to electrical ground, and hence provides a ground plane of thin-film chip 90. A back-side metal layer 95 may optionally be fabricated on the other face of thin-film chip 90.

Figure 10:
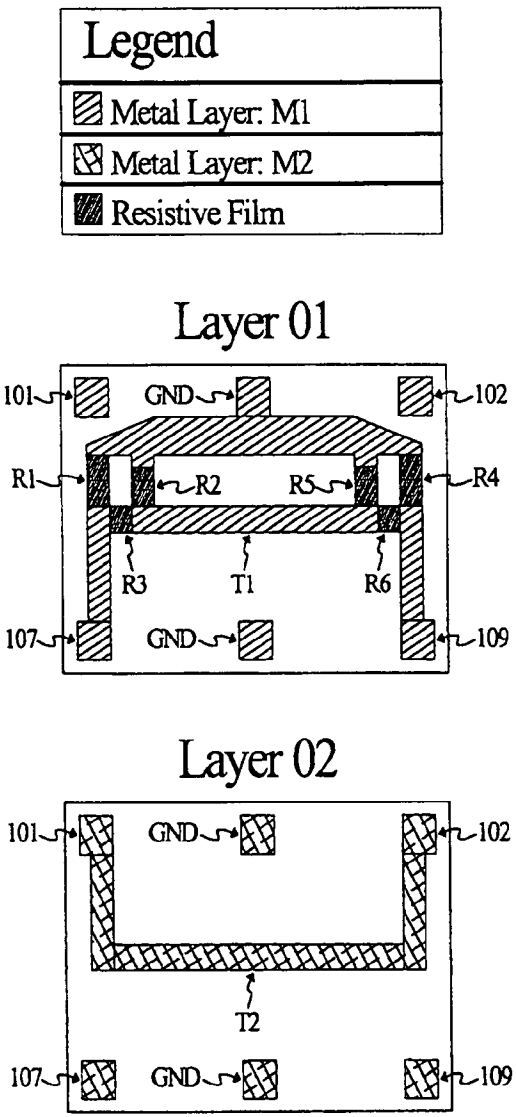
FIG. 10 shows an example layout of a directional coupler according to the present invention and implemented using thin-film technology as shown in FIG. 9.

FIG. 10 shows an example layout of a directional coupler according to the present invention and implemented using thin-film technology as described above. Layer 01 of FIG. 10 shows a suitable pattern for first metal layer 93A superimposed with resistive film layer 94, and Layer 02 of FIG. 10 shows a suitable pattern for second metal layer 93B. As mentioned in the description of FIG. 9, patterned insulating layers would typically be formed above, below and between Layer 01 and Layer 02, but these layers are not shown in FIG. 10.

The layout shown in FIG. 10 is based on the circuit diagram of a symmetrical directional coupler according to the present invention shown in FIG. 7 herein. Resistors R71, R72 and R73 are shown as R1, R2 and R3 respectively in FIG. 10, where R1, R2, and R3 each are rectangles of resistive film left behind after the process of patterning layer 94 has been completed. Similarly, resistors R74, R75 and R76 are shown as resistive film rectangles R4, R5 and R5 respectively in FIG. 10. The resistance of a rectangle of resistive film is easily calculated by counting the number of squares contained in the rectangle and by multiplying that number by a given constant for the resistive film; thus, it can be seen that the patterned rectangles of resistive film R1 R2 and R3 of FIG. 10 each have different resistances as would be predicted by equation 3 and equations 4 above.

The directional coupler layout of FIG. 10 comprises coupled transmission lines T1 and T2, corresponding to coupled transmission lines 75 of FIG. 7. Coupled transmission lines T1 and T2 of FIG. 10 are fabricated on separate layers, with an insulating layer between, and consequently the directional coupler of FIG. 10 comprises a pair of broadside coupled transmission lines, as depicted in FIG. 6A above.

Input/output ports of the directional coupler of FIG. 10 are labeled as follows: input port 101, direct port 102, coupled port 107 and isolated port 109. It should be noted that by symmetry, the input/output ports of the directional coupler of FIG. 10 might just as easily be labeled as input port 102, direct port 101, coupled port 109 and isolated port 107.

Electrical connection between Layer 01 and Layer 02 of FIG. 10 would typically be achieved by fabricating holes in the insulating layer separating Layer 01 and Layer 02. For example, holes would be formed in the insulating layer to permit electrical connection between the pads shown in FIG. 10.

The directional coupler of the present invention might alternatively be formed as a multilayer chip component comprising a plurality of electrically insulating layers where the insulating layers are stacked on top of each other and where patterned metallic circuit layers, and patterned metallic ground layers are interspersed between the insulating layers. In this case, the pair of coupled transmission lines is formed within the multilayer chip component, and the at least one impedance matching and impedance transforming attenuator is formed externally to the multilayer chip component.

Figure 11:
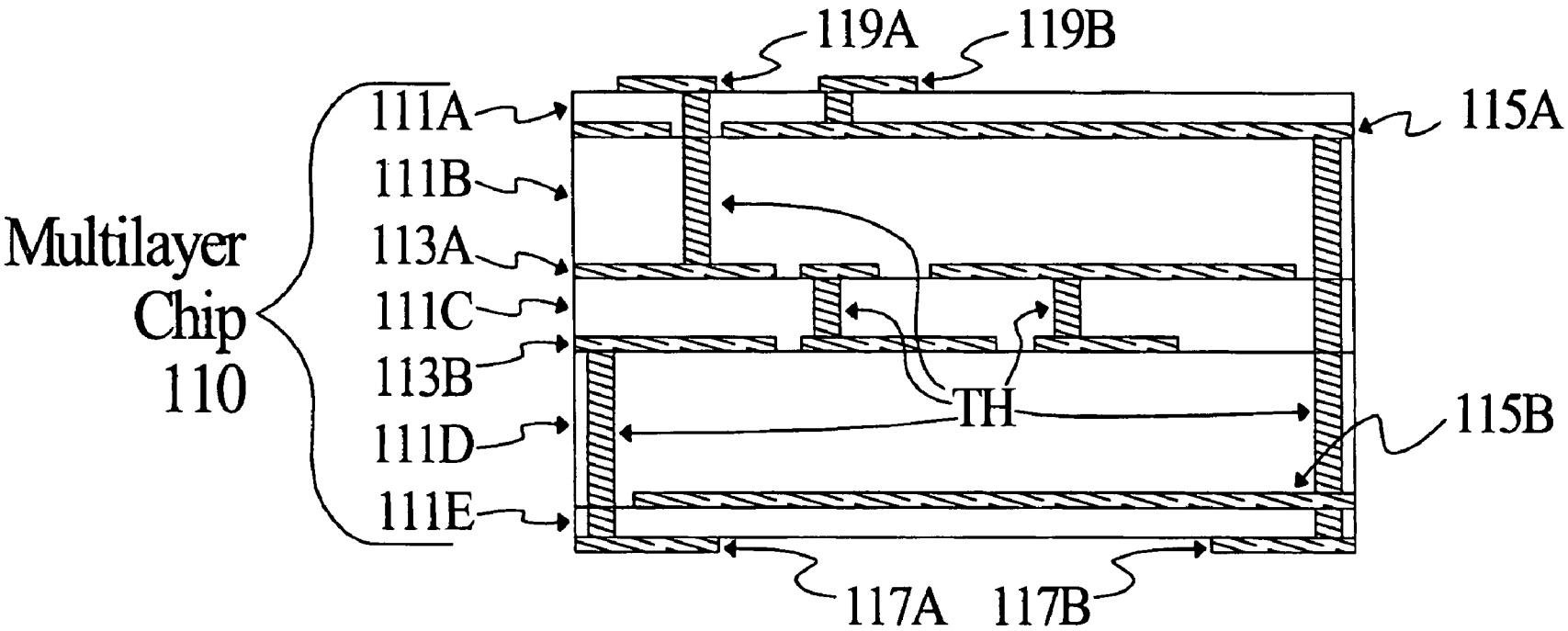
FIG. 11 shows a cross section drawing of a multilayer chip component suitable for the fabrication of a directional coupler according to the present invention.

FIG. 11 shows a cross section view of a multilayer chip component 110 suitable for the fabrication of a directional coupler according to the present invention.

Multilayer chip component 110 comprises a plurality of electrically insulating layers 111A, 111B, 111C, 111D, 111E, where the layers are stacked on top of each other. Electrically insulating layers 111A, 111B, 111C, 111D, 111E, are formed of a suitable insulating material, for example ceramic, or a composite material, where the material is suitable for a stacking and curing process, and where the material provides a high electrical Q or a low loss factor at RF and microwave frequencies—for example from 500 MHz to 60 GHz.

Interspersed between insulating layers 111A, 111B, 111C, 111D, 111E are patterned metallic circuit layers, 113A 113B, and patterned metallic ground layers 115A, 115B. The patterning of metallic circuit layers 113A, 113B and metallic ground layers 115A, 115B takes place during the fabrication process of multilayer chip component 110.

Patterned metallic circuit layers 113A and 113B, form a pair of coupled transmission lines, either broadside coupled—as shown in FIG. 6A or edge coupled—as shown to FIG. 6B. Patterned metallic ground layers 115A, 115B provide respective upper and lower ground planes for the pair of coupled transmission line. However, as noted herein, either or both of upper and lower ground planes 115A, 115B can be omitted from the chip structure, for example, in the case where there is a ground plane provided on by the carrier PCB on which multilayer chip component 110 is mounted.

Multilayer chip component 110 comprises metallic terminals 117A, 117B for electrical connection between multilayer chip component 110 and an external circuit (not shown). Metallic terminals 117A, 117B are preferably located on a reverse face of multilayer chip component 110. Multilayer chip component 110 may also include metallic SMT pads 119A, 119B for electrical connection between multilayer chip component and one or more SMT components to be mounted on an obverse face of multilayer chip component 110. Electrical connection between SMT pads 119A, 119B (if present), patterned metallic ground layers 115A, 115B, patterned metallic circuit layers 113A, 113B and metallic terminals 117A and 117B are provided by a plurality of electrically conducive through holes TH, which penetrate insulating layers 111A, 111B, 111C, 111D, 111E. Through holes TH are rendered electrically conductive during the fabrication of multilayer chip 110 by a process of filling each through hole TH with electrically conducive paste, or by a process of electroplating the inner surface of each through hole TH.

The pair of coupled transmission lines of the directional coupler of the present inventions may be formed on a pair of adjacent metallic circuit layers 113A, 113B of multilayer chip component 110 as shown in FIG. 11, or they may be formed on a single metallic circuit layer, for example in the case where the pair of coupled transmission lines are of the edge-coupled type, as shown in FIG. 6B. Alternatively, the pair of coupled transmission lines may be formed over several metallic circuit layers of multilayer chip component 110 (not shown).

The impedance matching and impedance transforming attenuator of the directional coupler of present invention may be formed externally to chip component 110, E.G. by a set of three SMT resistors mounted adjacent to the coupled port of the directional coupler, with appropriate values given by EQUATIONS 4a, 4b, 4c, 4d or 5a, 5b, 5c, 5d above. Alternatively, the impedance matching and impedance transforming attenuator may be formed on the surface of chip component

110, E.G. by mounting a set of three SMT resistors on a surface of multilayer chip component and where electrical contact between the SMT resistors and the other circuit elements (pair of coupled transmission lines, patterned metallic ground layers 115A, 115B etc.) is made by means of SMT pads 119A, 119B and through holes TH.

The present invention is not limited to the embodiments described herein.

The invention claimed is:

1. A directional coupler comprising:

a pair of coupled transmission lines, said pair of transmission lines being located in close proximity to each other so that they are electromagnetically coupled to each other, said pair of coupled transmission lines comprising a first transmission line and a second transmission line, said first transmission line comprising a first end, to which a first RF port is connected, and a second end to which a second RF port is connected, said second transmission line comprising a first end to which a third RF port is connected and a second end to which a fourth RF port is connected, so that an electrical signal fed to said first RF port produces a direct electrical signal at said second RF port, and a coupled RF signal at said third RF port, said pair of coupled transmission lines having an even mode impedance $Z_{0E}$ and an odd mode impedance $Z_{0O}$;

said directional coupler further including a first impedance matching and impedance transforming attenuator connected at said third port which provides a level of attenuation and which transforms a reference impedance value $Z_0$ connected to a fifth RF port to a transformed impedance $Z_{P3}$ not equal to $Z_0$ which appears at said third RF port, the value of $Z_{P3}$ being given by:

$$Z_{P3} = \frac{Z_{00} \times Z_{0E}}{Z_0},$$

wherein one or both of said first and second transmission lines has an increased width vis-à-vis the required width of each first and second transmission line when $Z_{P3}=Z_O$, and wherein the product of said even mode impedance and said odd mode impedance of said pair coupled transmission lines has a value that is less than $Z_O^2$.

2. The directional coupler of claim 1 wherein $Z_O=50\Omega$.

3. The directional coupler of claim 1 wherein said pair of coupled transmission lines are broadside coupled.

4. The directional coupler of claim 1 wherein said pair of coupled transmission lines are edge coupled.

5. The directional coupler of claim 1 wherein said first impedance matching and impedance transforming attenuator comprises a PI network connected between said third and fifth ports.

6. The directional coupler of claim 1 said directional coupler further including a second impedance matching and impedance transforming attenuator connected at said fourth port which provides a level of attenuation and which transforms a reference impedance value $Z_0$ connected to a sixth RF port to a transformed impedance $Z_{P4}$ which appears at said fourth RF port and where the value of $Z_{P4}$ is equal to the value of $Z_{P3}$.

7. The directional coupler of claim 1 wherein said pair of transmission lines are incorporated within a layered structure, said layered structure comprising a plurality of patterned layers of a metallic material interspersed with layers of an insulating material, said layered structure forming a chip component.

8. A power monitoring circuit including the directional coupler of claim 1.

9. An RF circuit including the directional coupler of claim 1.

10. A directional coupler comprising:

a pair of coupled transmission lines, said pair of transmission lines being located in close proximity to each other so that they are electromagnetically coupled to each other, said pair of coupled transmission lines comprising a first transmission line and a second transmission line, said first transmission line comprising a first end, to which a first RF port is connected, and a second end to which a second RF port is connected, said second transmission line comprising a first end to which a third RF port is connected and a second end to which a fourth RF port is connected, so that an electrical signal fed to said first RF port produces a direct electrical signal at said second RF port, and a coupled RF signal at said third RF port, said pair of coupled transmission lines having an even mode impedance $Z_{0E}$ and an odd mode impedance $Z_{0O}$;

said directional coupler further including a first impedance matching and impedance transforming attenuator connected at said third port which provides a level of attenuation and which transforms a reference impedance value $Z_0$ connected to a fifth RF port to a transformed impedance $Z_{P3}$ not equal to $Z_0$ which appears at said third RF port, the value of $Z_{P3}$ being given by:

$$Z_{P3} = \frac{Z_{00} \times Z_{0E}}{Z_0},$$

wherein one or both of said first and second transmission lines has an increased width vis-à-vis the required width of each first and second transmission line when $Z_{P3}=Z_O$, and wherein said first impedance matching and impedance transforming attenuator comprises a T network connected between said third and fifth ports.

11. A directional coupler comprising:

a pair of coupled transmission lines, said pair of transmission lines being located in close proximity to each other so that they are electromagnetically coupled to each other, said pair of coupled transmission lines comprising a first transmission line and a second transmission line, said first transmission line comprising a first end, to which a first RF port is connected, and a second end to which a second RF port is connected, said second transmission line comprising a first end to which a third RF port is connected and a second end to which a fourth RF port is connected, so that an electrical signal fed to said first RF port produces a direct electrical signal at said second RF port, and a coupled RF signal at said third RF port, said pair of coupled transmission lines having an even mode impedance $Z_{0E}$ and an odd mode impedance $Z_{0O}$;

said directional coupler further including a first impedance matching and impedance transforming attenuator connected at said third port which provides a level of attenuation and which transforms a reference impedance value $Z_0$ connected to a fifth RF port to a transformed impedance $Z_{P3}$ not equal to $Z_0$ which appears at said third RF port, the value of $Z_{P3}$ being given by:

$$Z_{P3} = \frac{Z_{00} \times Z_{0E}}{Z_0},$$

wherein one or both of said first and second transmission lines has an increased width vis-à-vis the required width of each first and second transmission line when $Z_{P3}=Z_O$, wherein said pair of transmission lines are incorporated within a layered structure, said layered structure comprising a plurality of patterned layers of a metallic material and at least one patterned layer of an insulating material, and wherein one of said patterned layers of a metallic material comprises a patterned resistive film layer, said resistive film layer providing said first impedance matching and impedance transforming attenuator.

12. The directional coupler of claim 11, wherein said layered structure and said substrate are incorporated in a chip component.

13. The directional coupler of claim 11, wherein said layered structure is fabricated on an insulating substrate.

14. An electrical component comprising the directional coupler of claim 11 mounted on a carrier PCB, said carrier PCB providing conducting trace lines for feeding electrical signals to and from said RF ports of said directional coupler.

15. The directional coupler of claim 14, wherein said carrier PCB includes a ground plane for said pair of coupled transmission lines.

* * * * *